United States Patent [19]

Judd

[11] 4,188,879

[45] Feb. 19, 1980

[54] REFUSE DISPOSAL SYSTEM

[75] Inventor: Robert L. Judd, St. Joseph, Mich.

[73] Assignee: Whirlpool Corporation, Benton Harbor, Mich.

[21] Appl. No.: 938,314

[22] Filed: Aug. 30, 1978

[51] Int. Cl.[2] ..... B30B 15/06

[52] U.S. Cl. ..... 100/229 A; 220/94 R; 220/410

[58] Field of Search ..... 220/94 R, 404, 409, 220/410, 318; 100/229 A, 229 R, 240

[56] References Cited

U.S. PATENT DOCUMENTS

| | | | |
|---|---|---|---|
| 2,111,359 | 3/1938 | Curtis | 220/94 R |
| 2,120,487 | 6/1938 | Conner | 220/94 R X |
| 3,491,913 | 1/1970 | Giraudet | 220/94 R |
| 3,586,200 | 6/1971 | Kramer | 220/94 R |
| 3,807,299 | 4/1974 | Engebretsen | 100/229 A |

*Primary Examiner*—Billy J. Wilhite

*Attorney, Agent, or Firm*—Wegner, Stellman, McCord, Wiles & Wood

[57] ABSTRACT

A refuse disposal system wherein a refuse container including a refuse holding receptacle portion and a removable closure cover is provided with a configuration adapted to have removable fit within the drawer support of a refuse compactor. When used in the compactor in effecting the compacting operation, the cover is omitted and suitably stored. The receptacle is provided with rope handles for facilitated installation and removal relative to the compactor drawer and for facilitated transport of the container to and from a trash pickup location. Turned-over flanges on the receptacle may cooperate with the cover for effectively removably securing the cover to the receptacle portion of the container while yet permitting use of the handles in effecting the transport with the cover in place. The container portions may be arranged to provide suitable rigidity and stiffness while being formed of synthetic resin material. Indicia may be provided on the container for indicating the intended reuse of the container.

6 Claims, 10 Drawing Figures

Fig. 1
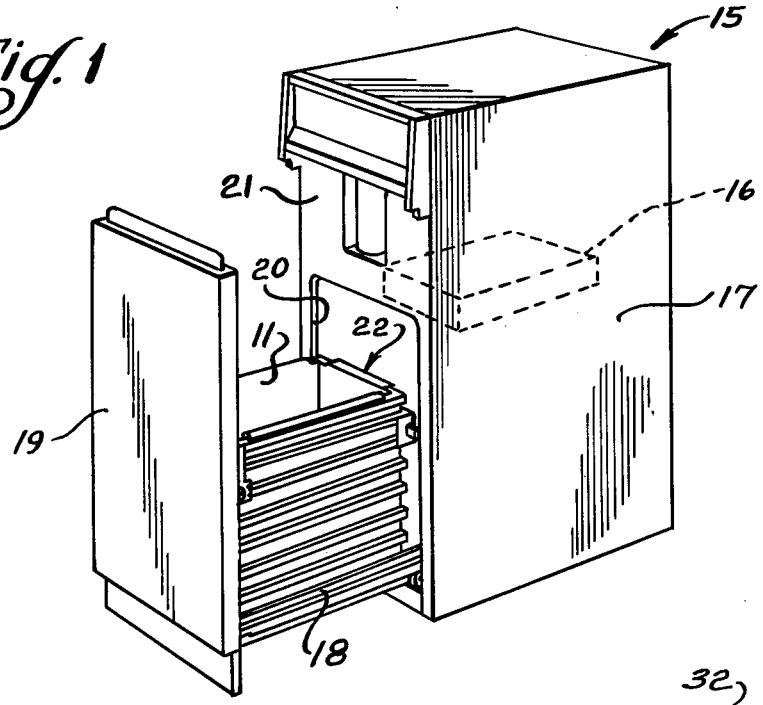
Fig. 2
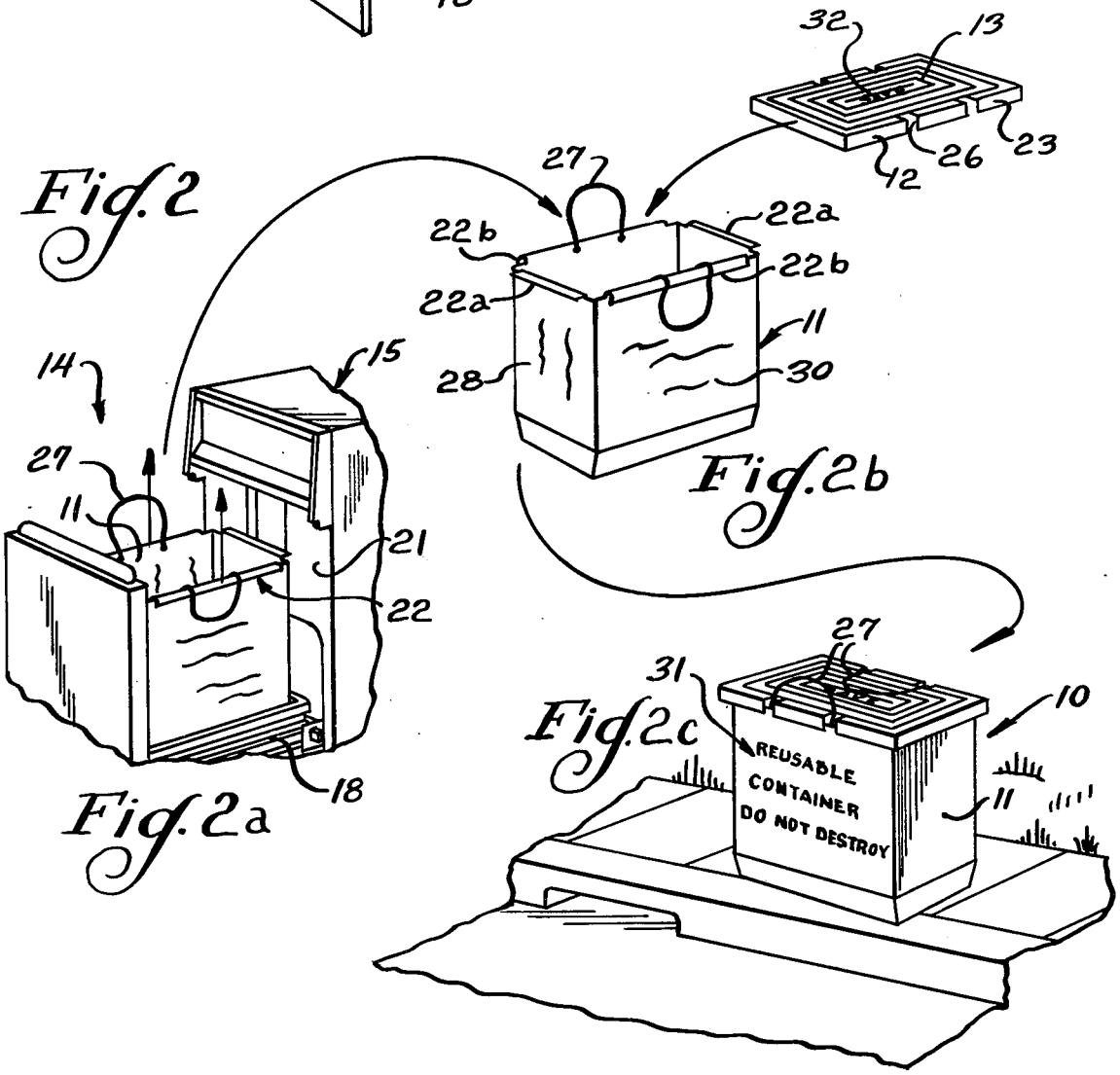
Fig. 2b
Fig. 2c
Fig. 2a

Fig. 3
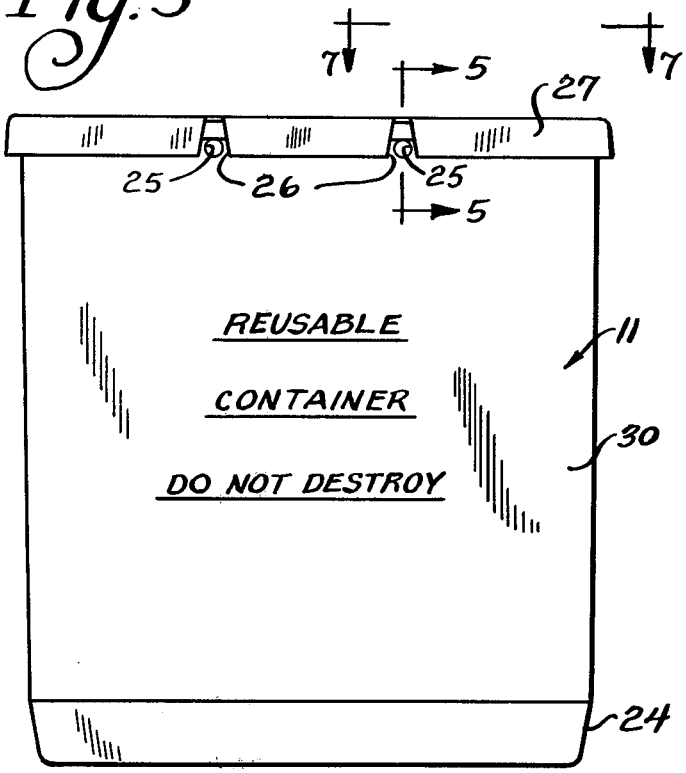
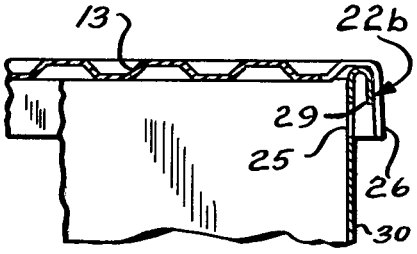
Fig. 5
Fig. 6
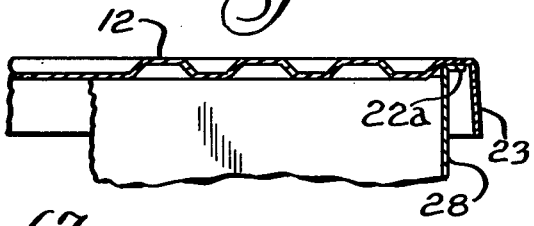
Fig. 4
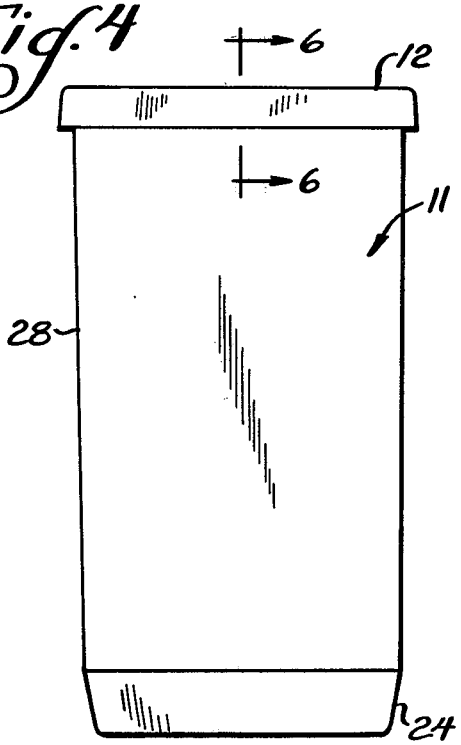
Fig. 7
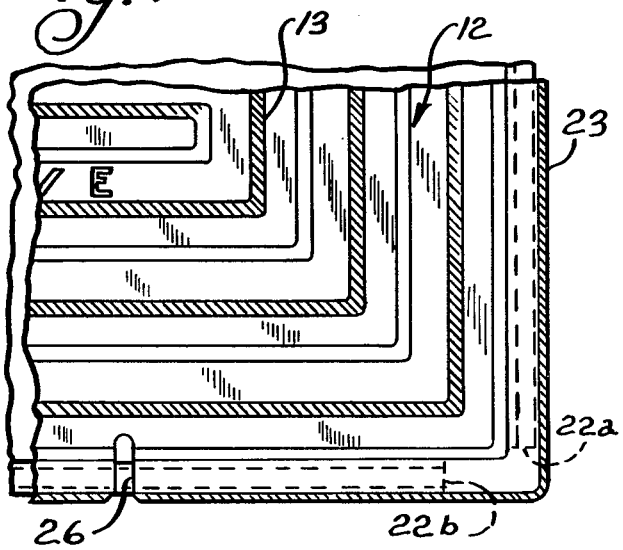

REFUSE DISPOSAL SYSTEM

TECHNICAL FIELD

This invention relates to refuse disposal systems and in particular to refuse disposal systems utilizing compacting means for compacting collected refuse and permitting transfer of the compacted refuse to a trash pickup location.

BACKGROUND ART

In one improved form of trash compactor, the trash is compacted by a suitable compacting ram after being placed in a drawer portion of the compactor. It is conventional to provide lining means for the drawer to hold the trash both in the compacting operation and subsequently in the disposal of the compacted trash. One conventional form of holding means comprises a synthetic resin bag.

It has been found desirable to provide improved cut and tear resistance inasmuch as bottles and cans are included in the trash conventionally compacted in such compactors. Relatively thick synthetic resin liners have been employed to protect the relatively tear-susceptible bag conventionally utilized. Another attempted solution to the problem is to utilize relatively expensive tear-resistant bags which may be formed of multiple plies of suitable material, such as paperboard, etc.

A number of different trash receptacles have been developed for receiving trash. Illustratively, a trash receptacle is shown in U.S. Pat. No. 3,502,238 of Robert A. Kelley, issued Mar. 24, 1970, wherein a disposable liner bag is provided within the outer receptacle by a suitable frame.

A trash compactor is illustrated in U.S. Pat. No. 3,601,953 of John A. Boyd, issued Aug. 31, 1971, as including a machine for compacting trash in a disposable carton mounted within a sleeve in the lower portion of the machine casing. The disposable carton may comprise a cardboard box, or the like, adapted to "be transported to a suitable site and burned or otherwise disposed of".

Einar O. Engebretsen, in U.S. Pat. No. 3,807,299 issued Apr. 30, 1974, shows a trash compactor with a removable liner which is formed as a reusable two-piece liner. The two sections of the liner are formed of substantially rigid self-supporting material, such as polyethylene, and is provided with integral handles. Upon removal of the liner with the refuse compacted therein, the liner may be emptied and replaced in the machine. The liner may further be adapted to support disposable bags, if desired.

Edward L. Macoicz, in U.S. Pat. No. 3,747,518 issued July 24, 1973, shows a trash compactor having means facilitating trash removal therefrom utilizing a sling conforming to the inside of the compacting bin and disposed to underlay the trash in the bin. Flap portions of the sling are adapted to be manually pulled upwardly from opposite sides of the bin and then brought together whereby the sling with the compacted trash enwrapped therein may be withdrawn from the bin by the operator and carried to a suitable final disposition site.

Jerome F. Stratman, et al, in U.S. Pat. No. 3,827,352 issued Aug. 6, 1974, show a refuse compactor container assembly which is provided on a slide or carriage and includes a lightweight, cylindrical plastic receptacle that may be removed from the slide for disposition of the compacted refuse therein. A plastic liner is disposed within the receptacle and is maintained in position by a cuff embracing or clamped against the external surface of the receptacle by a stretched retaining band.

In U.S. Pat. No. 3,845,707, issued Nov. 5, 1974, James H. Enright et al show a compactor having a trash basket shiftable in a seat of the mechanism. The basket may be formed of plastic material having flexible sidewalls yielding under pressure to the ram.

Robert F. Karls, in U.S. Pat. No. 3,863,561 issued Feb. 4, 1975, shows a compactor having two cubicles with trash containers therein. A single ram is mounted for shuttle movement from one cubicle to the other so that the ram may be utilized to compact trash in one cubicle while the trash container may be removed from the other cubicle for disposition of the compacted trash therefrom.

In U.S. Pat. No. 3,869,979, issued Mar. 11, 1975, owned by the assignee hereof, Charles E. Sulcek shows a refuse compactor receptacle utilizing a drawer-type support wherein a bag may be provided for receiving the refuse to be compacted and for facilitated disposition of the bagged compacted refuse when desired.

DISCLOSURE OF THE INVENTION

The present invention comprehends an improved refuse disposal system wherein a weatherproof refuse container formed of a synthetic resin material includes an upwardly opening refuse-receiving receptacle and a removable closure cover for closing the receptacle when utilized as a storage receptacle at the disposal site. The receptacle is adapted to be fitted in a support of a refuse compactor having compacting means disposed adjacent the support so as to permit the receptacle to removably receive trash to be compacted therein by the compacting means of the mechanism.

When utilized within the refuse compactor, the closure cover of the container is removed and suitably stored so as to permit the refuse compactor to suitably enter and compact refuse placed in the receptacle portion of the container.

The receptacle has a configuration preselected to have a ready removable fit within the drawer portion of the refuse compactor so as to be supported by the drawer portion during the compacting operation while yet permitting facilitated removal of the receptacle for use as a closed storage means at the disposal site when desired.

The receptacle may include an upper portion defining turned over flanges of the receptacle for added rigidity thereof. The flanges may be arranged to have cooperative association with the cover for effecting desirable retention of the cover on the receptacle portion of the container when desired.

Rope handles may be attached to the receptacle for facilitated transport of the receptacle to and from the trash pickup location. The handles may be arranged to be engaged by the user notwithstanding the disposition of the cover on the receptacle for facilitated disposal.

Suitable indicia means may be provided on the container for indicating the intended reuse of the container.

Thus, the invention comprehends an improved refuse disposal system wherein a refuse storage container intended for use at a trash pickup location for collection of compacted refuse therein by a refuse collection agency is arranged and configured to be removably fitted in and supported by the support drawer of a refuse compactor for temporary use in the compactor as a substitute for the conventional collecting bag.

DESCRIPTION OF THE DRAWING

Other features and advantages of the invention will be apparent from the accompanying description taken in connection with the accompanying drawing wherein:

FIG. 1 is a perspective view of a refuse compactor having a refuse container receptacle embodying the invention removably installed in the drawer thereof;

FIGS. 2*a*, 2*b*, and 2*c* together show an exploded view illustrating the removal of the container receptacle from the compactor drawer, the placement of the container cover thereon to close the receptacle and the disposition of the covered receptacle in a trash pickup location;

FIG. 3 is an enlarged side elevation of the receptacle;

FIG. 4 is an end elevation thereof;

FIG. 5 is a fragmentary section taken substantially along the line 5—5 of FIG. 3;

FIG. 6 is a fragmentary section taken substantially along the line 6—6 of FIG. 4; and FIG. 7 is an enlarged fragmentary plan view taken substantially along the line 7—7 of FIG. 3.

BEST MODE FOR CARRYING OUT THE INVENTION

In the illustrative embodiment of the invention as disclosed in the drawing, the best mode for carrying out the invention is shown to comprise a container generally designated 10 formed of a synthetic resin material and including an upwardly opening refuse receiving receptacle 11 and a removable closure cover 12 for selectively closing the receptacle such as when the receptacle is disposed in a trash pickup location such as shown in FIG. 2*c*.

As shown in FIG. 2*b*, the cover is adapted to be removably installed on the upper open end of the receptacle and may be provided with suitable ribs 13 for rigidifying the cover.

As indicated briefly above, the container 10 is utilized in a refuse disposal system generally designated 14, which is best illustrated in FIG. 2, as including a refuse compactor generally designated 15 having a compacting means 16 (see FIG. 1) disposed within an outer cabinet 17 of the compactor. Refuse is compacted within a support drawer generally designated 18 provided with a front panel 19 for selectively closing an opening 20 in the front wall 21 of the cabinet 17 into which and from which the drawer moves between a compacting position below the compacting means 16 within the cabinet 17 and a refuse admitting position wherein the drawer is moved outwardly through the opening 20 to an access position as shown in full lines in FIG. 1.

As indicated briefly above, it is conventional to line a support drawer 18 with a suitable enclosure bag, or the like, to hold the compacted refuse for facilitated disposition such as delivery to a trash pickup location. The present invention effectively eliminates the need for such a liner and, thus, effectively minimizes the cost of the refuse compacting disposal. More specifically, the present invention comprehends utilizing the storage container 10, as shown in FIG. 2*c*, in part as the means for containing the refuse during the compacting operation within the drawer 18. Thus, the present system eliminates the need for the trash compacting bags and similar liners of the prior art in that it utilizes the storage container itself to provide such desirable enclosure of the refuse during the compacting operation.

More specifically, as seen in FIG. 1, the invention comprehends installing the receptacle portion 11 of the container 10 in the drawer 18 so as to receive the refuse to be compacted and to hold the collected refuse in position below the compacting means ram 16 for facilitated compaction of the refuse directly in the receptacle 11. To permit such improved operation, the receptacle 11 has a preselected configuration complementary to the drawer 18 so as to permit ready removable fit of the receptacle 11 within the drawer in the arrangement of FIG. 1. During such use of the receptacle, the closure cover 12 may be stored as desired.

Upon completion of compaction of the desired amount of refuse within the receptacle 11 in compactor 15, the user merely lifts the receptacle with the compacted refuse therein upwardly from the drawer 18, as shown by the arrows in FIG. 2*a*, with the drawer being disposed in the access position forwardly of the front wall 21 of the cabinet.

Upon removal of the receptacle 11 with the compacted refuse therein, the user then merely places the cover 12 in closing relationship to the top of the receptacle.

As shown in FIG. 2*b*, the receptacle defines at its top edge a plurality of outwardly projecting flanges 22 which provide rigidity for the sidewalls 28 and 30 of the receptacle 11 and which serve as means for abutment with the downturned side flanges 23 of the cover 12 to removably retain the cover on the upper end of the receptacle. As shown in FIG. 3, holes 25 are provided in the sides 30 to receive rope carrying handles 27 as illustrated in FIGS. 2*a* and 2*b* so as to permit facilitated carrying of the closed, filled receptacle to the trash disposal position, such as shown in FIG. 2*c* of FIG. 2. Slots 26 are provided in the cover so that the cover can be applied to the receptacle when the handles 27 are positioned for carrying the receptacle as illustrated in FIG. 2*c*. As further shown in FIG. 2*c*, the closed container 10 may be then left at the trash pickup location for collection of the compacted refuse therefrom by the normal conventional collection agencies, such as a municipal garbage-collecting department.

Referring now more specifically to the details of the container 10, as shown in FIGS. 3–7, the receptacle 11 defines a slightly inturned base portion 24 for facilitating insertion into the drawer 18.

As seen in FIG. 6, the flanges 22*a* on the end walls 28 of the receptacle extend merely straight out from the top of the end walls whereas the flanges 22*b* in the sidewalls, as seen in FIG. 5, include downturned end portions 29. Each of the flanges, however, is arranged to have abutment with the downturned flange 23 of the cover so as to effectively define means for retaining the cover in place in the receptacle closing position, such as shown in FIGS. 2, 3 and 4.

In the illustrated embodiment, the container 10 is formed of a molded synthetic resin and, thus, may be of relatively low cost while yet providing high cut and tear resistance in containing the refuse compacted therein. As indicated above, the container is reusable and, thus, it is desirable to make it clear to persons, such as the trash collection personnel, that the container is not to be discarded with the compacted refuse. For this purpose, suitable indicia, such as indicia 31 on the receptacle 11 and indicia 32 on the cover 12 may be provided. Illustratively, the indicia may be in the form of integral molded wording on the receptacle and cover, respectively, or printed thereon as desired.

The flange portions of the receptacle may be relatively flexible so as to provide improved fricational grip with the flanges of the cover so as to assure maintenance of the cover on the receptacle when placed outdoors, such as shown in FIG. 2*c*. The container 10 is preferably formed of a weather-resistant synthetic resin, and in the illustrated embodiment, is formed of medium density polyethylene. Thus, the container has the further advantage of being relatively light in weight for facilitated transport such as by a housewife or the like from the compactor 15 to the trash pickup location. Further, the light weight of the container facilitates cleaning thereof for improved sanitation in the reuse thereof.

As shown in FIG. 1, the flanges 22 overlap the top of the drawer for facilitated upward movement of the receptacle 11 from the compacting position shown in FIG. 1, and the removal movement thereof as shown in FIG. 2*a*.

The foregoing disclosure of specific embodiments is illustrative of the broad inventive concepts comprehended by the invention.

The embodiment of the invention in which an exclusive property or privilege is claimed are defined as follows:

1. In a refuse disposal system having a plurality of weatherproof refuse containers each formed of a synthetic resin material and including an upwardly open refuse-receiving receptacle and a removable cover closing the receptacle, the improvement comprising:

a refuse compactor having compacting means and a support complementary to and removably receiving selectively said receptacles in a compacting disposition adjacent said compacting means, said compacting means being arranged to selectively compact refuse disposed in said container on said support in said compacting disposition, said drawer effectively fully supporting said container during the refuse compacting operation, thereby permitting alternate selective use of each container as a removable holder within the compactor and a disposal storage container remotely of said compactor.

2. The refuse disposal system of claim 1 wherein said support comprises a drawer.

3. The refuse disposal system of claim 1 wherein said receptacle includes carrying handles for facilitated transport of the receptacle to and from a trash pickup location whereat said receptacle with compacted refuse therein and may be temporarily disposed for collection of the compacted refuse by a suitable collection agency.

4. The refuse disposal system of claim 1 wherein said receptacle includes an upper portion defining turned over flanges said cover having a portion arranged to abut said flanges to retain the cover on the receptacle in the closed arrangement of the container.

5. The refuse disposal system of claim 1 wherein said receptacle includes an upper portion defining flanges, a pair of handles attached to said receptacle for facilitated transport of the receptacle to and from a trash pickup location whereat said receptacle with compacted refuse therein and said cover secured thereto to effectively close the receptacle may be temporarily disposed for collection of the compacted refuse by a suitable collection agency, said cover having a portion arranged to abut said flanges to retain the cover on the receptacle in the closed arrangement of the container, and slots formed in said cover for passage of the handles therethrough to permit transport of said container by said handles with said cover disposed on said receptacle.

6. The refuse disposal system of claim 1 wherein indicia means are provided on said container indicating the intended reuse of the container.

* * * * *

UNITED STATES PATENT AND TRADEMARK OFFICE

CERTIFICATE OF CORRECTION

PATENT NO. : 4,188,879

DATED : February 19, 1980

INVENTOR(S) : ROBERT L. JUDD

It is certified that error appears in the above-identified patent and that said Letters Patent are hereby corrected as shown below:

Column 6, line 1 (Claim 1), after "said" (second occurrence), cancel "drawer" and substitute therefor --support--.

Signed and Sealed this

*Seventeenth* Day of *June 1980*

[SEAL]

*Attest:*

SIDNEY A. DIAMOND

*Attesting Officer*

*Commissioner of Patents and Trademarks*